United States Patent [19]

Koopmann

[11] Patent Number: 4,605,832

[45] Date of Patent: Aug. 12, 1986

[54] DIFFERENTIAL BELLOWS PRESSURE SWITCH

[75] Inventor: Gerd Koopmann, Rosrath, Fed. Rep. of Germany

[73] Assignee: Leybold Heraeus GmbH, Fed. Rep. of Germany

[21] Appl. No.: 617,003

[22] Filed: Jun. 4, 1984

[30] Foreign Application Priority Data

Nov. 15, 1983 [DE] Fed. Rep. of Germany ... 8332797[U]

[51] Int. Cl.[4] ..... H01H 35/32

[52] U.S. Cl. ..... 200/83 D; 200/81.4; 200/81.5

[58] Field of Search ..... 92/39; 73/716, 717, 73/729; 200/302, 81.4, 81.5, 83 C, 83 D

[56] References Cited

U.S. PATENT DOCUMENTS

| | | | |
|---|---|---|---|
| 2,635,153 | 4/1953 | Wilson | 92/39 |
| 2,672,889 | 3/1954 | Swanson | 92/39 |
| 3,094,839 | 6/1963 | Kinney | 92/39 |
| 3,361,037 | 1/1968 | Likavec | 92/39 |
| 3,501,959 | 3/1970 | Womack | 200/83 D |

FOREIGN PATENT DOCUMENTS 2925243 1/1981 Fed. Rep. of Germany .

*Primary Examiner*—G. P. Tolin

*Attorney, Agent, or Firm*—Sughrue, Mion, Zinn, Macpeak & Seas

[57] ABSTRACT

A differential pressure switch with a housing having two faces opposite each other which comprises two approximately coaxial bellows arranged in the housing, so that each bellows has one of its sides securely fastened to a face of the housing, with a dividing sheet arranged between the bellows such that two separated work chambers are formed. Each work chamber is defined by one face of the housing, by a bellows and by the dividing sheet. The dividing sheet has a section projecting sideways through the bellows for switch control.

8 Claims, 1 Drawing Figure

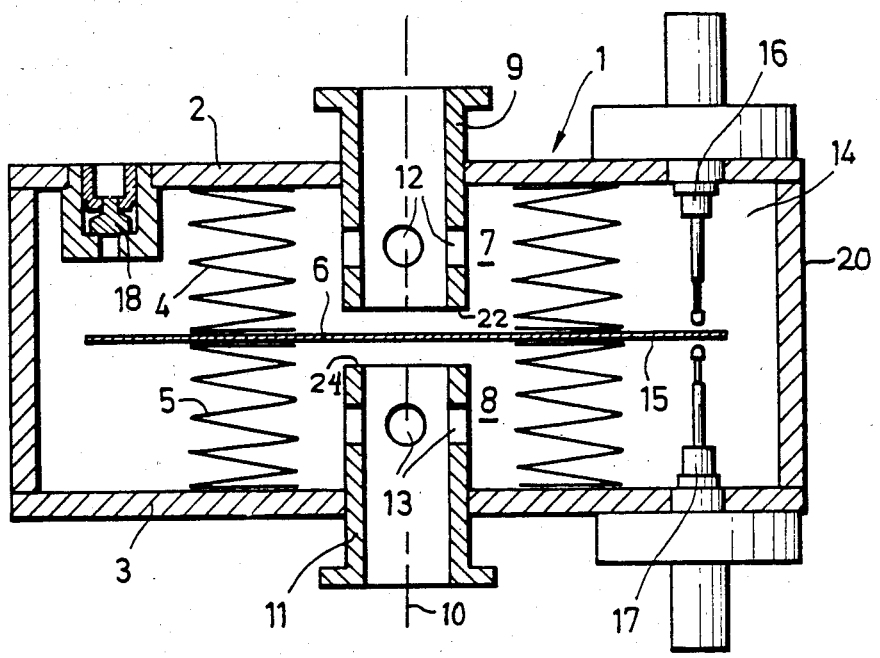
9
1
16
2
14
12
7
20
6
18
4
22
24
5
8
15
13
3
11
10
17

DIFFERENTIAL BELLOWS PRESSURE SWITCH

BACKGROUND OF THE INVENTION

The present invention relates to a differential pressure switch with a housing.

Known differential pressure switches have two chambers divided by a diaphragm, in which switches and/or adjustment devices are contained. See, for example, DE-OS No. 29 25 243. These components come into contact with working media. These kinds of differential pressure switches are therefore not useful with aggressive and/or reactive media.

SUMMARY OF THE INVENTION

It is an object of the present invention to provide a differential pressure switch which is also useful for aggressive or reactive media.

Additional objects and advantages of the present invention will be set forth in part in the description which follows and in part will be obvious from the description or can be learned by practice of the invention. The objects and advantages are achieved by means of the apparatus, instrumentalities and combinations particularly pointed out in the appended claims.

To achieve the foregoing objects and in accordance with its purpose, the present invention provides a differential pressure switch containing a housing having two faces opposite each other, comprising two approximately coaxial bellows arranged in the housing, with each bellows having one of its sides securely fastened to a face of the housing, and a dividing sheet arranged between the bellows in such a way that two separated work chambers are formed, each work chamber being defined by one face of the housing, by a bellows and by the dividing sheet, the dividing sheet having a section projecting sideways through the bellows for switch control.

A differential pressure switch formed in this manner has no components (e.g., switches or adjustment devices) placed in the work chambers that could be damaged by aggressive media. Only the dividing sheet (partition), the bellows and a part of the inner wall of the housing are in contact with aggressive media. When these housing parts that come in contact with the media consist of, for example, high quality austenitic special steel, then the pressure switch according to the present invention can also be used in chemistry and in nuclear technology.

The outer chambers, formed by the bellows and the remaining walls of the housing, which contain the switch or switches, can remain open to the atmosphere. It is nevertheless especially advantageous when this outer chamber is vacuum sealed. With this kind of design of the differential pressure switch, should an accident occur in a process with reactive gas which could lead to an extreme super pressure, through which a bellow would become leaky, then the gas cannot escape outside.

Preferably, the two chambers are each equipped, in the area of the housing face, with a fitting for connection to a chamber containing a working fluid. The fittings are arranged preferably on both sides of the dividing sheet in a manner to prevent a strain of the bellows. The fittings preferably project so far into the work chambers that the fittings concurrently form support elements.

Preferably, the two bellows, and the remaining parts of the housing form an outer chamber which is formed to be vacuum sealed. The outer chamber preferably is equipped with a valve.

Preferably, the section of the dividing sheet that projects through the bellows in provided with two switches lying across from each other.

Preferably, portions of the fittings that are in the work chambers are each equipped with lateral borings. At least the dividing sheet, the bellows and the remaining housing parts that form the two working chambers preferably consist of high quality steel. The bellows preferably are formed as membrane bellows.

It is to be understood that both the foregoing general description and the following detailed description are exemplary and explanatory, but are not restrictive of the invention.

BRIEF DESCRIPTION OF THE DRAWING

The sole drawing figure is a cross-sectional view of one embodiment of the switch of the present invention.

DETAILED DESCRIPTION OF THE INVENTION

Referring now to the drawing, there is shown an essentially cylindrical housing 1 having two faces 2 and 3 opposite each other and a cylindrical side wall 20. Between faces 2 and 3 are arranged two bellows, 4 and 5, which preferably are designed as membrane or diaphragm bellows consisting of two bellows welded together. A partition or dividing sheet 6 is arranged between bellows 4 and 5. Bellows 4 and 5 are each welded to partition 6, and to the indicated faces respectively, so that work chambers 7 and 8 are formed. A fitting 9 extends through face 2 and is positioned in chamber 7, and a fitting 11 extends through face 3 and is positioned in chamber 8. Chambers 7 and 8 are connectable via fittings 9 and 11 with receivers or chambers, which are not shown, in which a working fluid is present and in which pressures prevail by means of which the described differential pressure switch is controlled.

Fittings 9 and 11 project so far into work chambers 7 and 8 that the end faces 22 and 24 of fittings 9 and 11 lie near partition 6 and thereby form supporting elements for partition 6 when it moves in response to large and sudden pressure changes, which supporting elements bellows 4 and 5 from a strain on both sides. In this case, in order to prevent sealing of the fitting from the work chambers caused by partition 6 coming in contact with the end face of the fitting, fittings 9 and 11 are each equipped with lateral openings 12 and 13, respectively in their side walls. The system is essentially cylindrically formed. The axis of the system is designated with 10.

Bellows 4 and 5, as well as the remaining wall portions of housing 1, (i.e., side wall 20 and the portions of faces 2 and 3 that extend past bellows 4 and 5) form an outer chamber 14, which in the case of a cylindrical housing 1 is circular in form. A circular section 15 of partition 6 projects into outer chamber 14 by means of which the switch is operated.

In the explanatory example shown, two switches 16 and 17 are provided lying across from each other, so that switch operations are possible in both directions.

It is advisable for the use of the differential pressure switch according to the present invention in chemical and nuclear technology to design circular chamber 14 to be vacuum tight, preferably up to 6 bar, so that in the case of destruction of one of the bellows, aggressive gases entering into the circular chamber 14 cannot escape into the environment. A valve 18 is provided, by means of which a discharge of circular chamber 14 is possible.

The structrue of the differential pressure switch according to the present invention is simple and sturdy. If the parts which come into contact with the media consist of high quality steel, then the differential pressure switch can be used for aggressive or reactive media. In addition, the use of a vacuum sealed outer chamber 14 creates a further safety barrier for such applications. By using diaphragm bellows with equal mechanical and thermal characteristics, a differential pressure switch can be achieved with a negligible temperature drift.

It will be understood that the above description of the present invention is susceptible to various modifications, changes, and adaptations, and the same are intended to be comprehended within the meaning and range of equivalents of the appended claims.

What is claimed is:

1. Differential pressure switch containing switch means and a housing having two faces opposite each other, comprising:

(a) two approximately coaxial bellows arranged in the housing, with each bellows having one of its sides securely fastened to a face of the housing;

(b) a dividing sheet arranged between the bellows such that two separated work chambers are formed, each work chamber being defined by one face of the housing, by a bellows and by the dividing sheet, the dividing sheet having a section projecting sideways beyond the bellows for switch control of said switch means, wherein the two work chambers are each equipped, in the area of its housing face, with a fitting for connection to a receiver chamber containing a working fluid, with the fittings being arranged on both sides of the dividing sheet to prevent a strain of the bellows, and projecting so far into the work chambers that the fittings concurrently form support elements for the dividing sheet.

2. Differential pressure switch according to claim 1, wherein the portions of the fittings that are in the work chambers are equipped with lateral borings.

3. Differential pressure switch according to claim 1, wherein the two bellows and remaining parts of the housing form an outer chamber which is vacuum sealed.

4. Differential pressure switch according to claim 3, wherein the outer chamber is equipped with a valve.

5. Differential pressure switch according to claim 1, wherein the housing is provided with said switch means in the form of two switches lying across from each other in the area where the dividing sheet contains the section which projects beyond the bellows.

6. Differential pressure switch according to claim 1, wherein at least the dividing sheet, the bellows, and the housing faces that form the two chambers consist of high quality steel.

7. Differential pressure switch according to claim 1, wherein the bellows are formed as membrane bellows.

8. Differential pressure switch according to claim 1, wherein each fitting extends beyond its work chamber and housing face and contains an opening in its extended portion to provide for communication of the working fluid between the work chamber of the bellows and the receiver chamber.

* * * * *